US006826984B2

(12) United States Patent
Poppen

(10) Patent No.: US 6,826,984 B2
(45) Date of Patent: Dec. 7, 2004

(54) LOCK NUT SOCKETS

(76) Inventor: Keith K Poppen, 635 Riverside Dr., South Elgin, IL (US) 60177

( * ) Notice: Subject to any disclaimer, the term of this patent is extended or adjusted under 35 U.S.C. 154(b) by 83 days.

(21) Appl. No.: 10/277,427

(22) Filed: Oct. 21, 2002

(65) Prior Publication Data

US 2004/0074347 A1 Apr. 22, 2004

(51) Int. Cl.[7] ..... B25B 13/48
(52) U.S. Cl. ..... 81/176.15; 81/436
(58) Field of Search ..... 81/176.15, 436, 81/460, 461, 121

(56) References Cited

U.S. PATENT DOCUMENTS

| | | | | | |
|---|---|---|---|---|---|
| 2,697,370 | A | | 12/1954 | Brooks | |
| 3,768,345 | A | * | 10/1973 | Barnes | 81/176.15 |
| 4,130,399 | A | * | 12/1978 | Hallerback | 29/225 |
| 4,488,596 | A | | 12/1984 | Akkerman | |
| 4,762,031 | A | | 8/1988 | Bradley | |
| 4,796,492 | A | | 1/1989 | Lion | |
| 4,836,065 | A | * | 6/1989 | Setliff | 81/124.2 |
| 4,863,148 | A | | 9/1989 | Hufnagel | |
| 4,955,262 | A | | 9/1990 | Womack | |
| 4,964,319 | A | | 10/1990 | Chang | |
| 4,982,627 | A | * | 1/1991 | Johnson | 81/121.1 |
| 5,216,941 | A | * | 6/1993 | Kolvereid | 81/461 |
| 5,259,281 | A | | 11/1993 | Burke | |
| 5,697,268 | A | * | 12/1997 | Makovsky et al. | 81/125 |
| 5,743,158 | A | | 4/1998 | Perkins | |
| 6,073,520 | A | | 6/2000 | Bueno | |
| 6,282,989 | B1 | * | 9/2001 | Sorter | 81/57.13 |
| 6,564,679 | B1 | * | 5/2003 | Llamas et al. | 81/176.15 |

* cited by examiner

*Primary Examiner*—Lee D. Wilson
(74) *Attorney, Agent, or Firm*—Meroni & Meroni, P.C.; Charles F. Meroni, Jr.

(57) ABSTRACT

A socket for manipulating a conduit lock nut comprises a wall enclosing a circular area equal to an outer diameter of a lock nut terminates in a lip. A plurality of teeth spaced at a predetermined distance engage lugs of a lock nut. The teeth have sufficient height to engage the lugs when force is applied to the socket. A centering stem within the wall coacts with an inner wall of an electrical conduit opening to axially align the teeth with lugs of a lock nut about the opening. A tapered lead in provides spatial relief for initial engagement of the stem with an inner wall of an opening. A well between the stem and the teeth provide a recess for protruding walls of an electrical conduit opening to reside in during engagement of the teeth with lugs of a lock nut about the opening.

16 Claims, 2 Drawing Sheets

LOCK NUT SOCKETS

BACKGROUND OF THE INVENTION

1. Field of the Invention

The present invention generally relates to sockets. More specifically, the present invention relates to sockets for use with electrical conduit lock nuts.

2. Description of the Prior Art

There have been many different types of electrical conduit connectors developed to connect conduit carrying electrical circuits. A common way of securing the conduit connectors is to use a lock nut having a plurality of lugs about the lock nut for tightening of the lock nut about threads of a conduit end opening. These lock nuts are typically tightened and loosened by someone such as an electrician during installation or disassembly of an electrical conduit structure.

Lock nuts of this type have typically been tightened or loosened by placing the tip of a flat bladed screwdriver against a lug of the lock nut and striking the handle of the screwdriver with a hammer to manipulate the lock nut about threads of a conduit end opening. This method of manipulating a lock nut can be dangerous in that a person attempting to strike the handle of a screwdriver for this reason may inadvertently miss the handle all together or cause the blade of the screwdriver to dislodge from the lug of the lock nut and be redirected toward another object with a potentially great amount of force being concentrated in the tip of blade possibly causing puncture damage to other objects.

Therefore, there is a need for a device that provides a more suitable means of manipulating a lock nut about the threads of an electrical conduit connector opening. There are several different types of tools disclosed in the prior art having tooling profiles that are designed for other applications. Several of these tools are disclosed here.

U.S. Pat. No. 6,073,520 issued to Bueno discloses a wrench for removing stud bolts that are damaged. The annular wall has an inner cam-shaped surface with cam members inwardly protruded that limit the angular displacement of the gripping toothed dog members when a user actuates the handle assembly.

U.S. Pat. No. 4,796,492 issued to Liou discloses a socket wrench having a handled hollow head receiving a torque transmitting sleeve member which is provide with peripheral teeth to engage with inwardly extending teeth of the hollow head.

U.S. Pat. No. 4,762,031 issued to Bradley discloses an improved ratchet wrench which allows the socket to be turned without pivoting the handle. The improvements include a flat gear which either fits over the drive stud of the wrench's heads and is sandwiched in between the heard and a socket snapped on the head or is made integrally with the head. The gear projects beyond the socket and has driven hear teeth about its periphery.

U.S. Pat. No. 4,488,596 issued to Akkerman discloses an apparatus for locking a tool into an annular grove formed on the interior of a subterranean well includes a segmented lock ring expandable into the grove by axially shiftable tapered keys wedged between segments of the ring.

U.S. Pat. No. 4,130,399 issued to Hallerback discloses a tool for dismantling a locking ring consisting of a annular portion having a plurality of radially projecting circumferentially spaced locking tongues for supporting a bearing element such as a ring in an opening in a housing or the like. The dismantling tool comprises a generally disc-like member having a circumferential rib depending from one axial face thereof adapted to abut the annular portion of the locking ring radially inwardly of the locking tongues.

U.S. Pat. No. 2,697,370 issued to Brooks discloses a ratchet type socket wrench having recessed gripping teeth sized and shaped to interact with protruding teeth of the mating portion of the ratchet type socket wrench.

These tools of the prior art generally teach designing tools with tooling profiles conforming to the profile of a particular fastener. However, the prior art does not teach or disclose a socket type tool for the manipulation of a lock nut and the special considerations taken into consideration when arriving at a socket for lock nuts.

SUMMARY OF THE INVENTION

With the foregoing need in mind, the claimed invention provides a lock nut socket for use in manipulating a lock nut about the threads of an electrical conduit connector opening.

The socket generally comprises a skirt wall, a plurality of teeth, a centering stem or guide with a tapered lead in, and a recess well or gap. The socket can be sized to engage a variety of different sizes of standard lock nuts and can be grouped in a plurality of sizes to form a set.

The skirt wall has a uniform thickness and is sized and shaped to enclose a circular area substantially equal to an outer ring diameter of a standardized electrical conduit lock nut. The wall has a substantially smooth inner face and a substantially smooth outer face that terminate to form a substantially flat lip.

The plurality of uniformly radially spaced teeth extend from the lip of the wall and are sized and shaped to matingly engage lugs of an electrical conduit lock nut. The teeth are spaced about the flat lip of the rigid wall to sliplessly engage lugs of varying width when torsional force is applied to the socket.

The centering stem centered within the skirt and is sized and shaped to coact with an inner wall of an electrical conduit opening to axially align the spaced teeth with lugs of an electrical conduit lock nut about the electrical conduit opening. The tapered lead in portion about the centering stem provides spatial relief for initial engagement of the centering stem with an inner wall of an electrical conduit opening.

The recess well between the centering stem and the teeth provide a clearance recess for protruding walls of an electrical conduit opening to reside in during engagement of the teeth with lugs of an electrical conduit lock nut when the lock nut is about an electrical conduit opening.

BRIEF DESCRIPTION OF THE DRAWINGS

FIG. 1 shows a perspective view of the lock nut socket.

FIG. 2 shows a bottom view of the lock nut socket.

FIG. 3 shows a top view of the lock nut socket.

FIG. 4 shows a cross sectional view of the lock nut socket.

FIG. 5 shows a side view of the lock nut socket.

FIG. 6 shows a lock nut socket engaging a lock nut tightened about the threads of an electrical conduit connector opening.

FIG. 7 shows a perspective view of a lock nut and a lock nut socket.

DETAILED DESCRIPTION OF THE PREFERRED EMBODIMENTS

Figure 1:
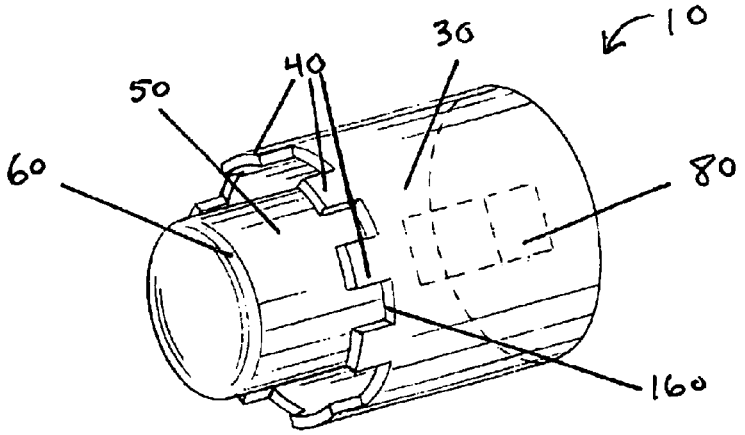
FIG. 1.
Figure 2:
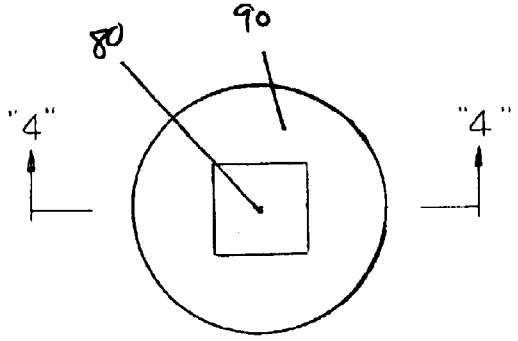
FIG. 2.

Turning now to the drawings, a socket 10 for use in manipulating an electrical conduit lock nut 20 is shown in FIGS. 1–5. It is contemplated that sockets of differing size will be designed to accommodate lock nuts of differing size with the basic structure of the socket 10 remaining substantially the same. The socket 10, preferably made of case hardened steel, generally comprises a rigid skirt 30, a plurality of teeth 40, a centering stem or guide 50, a tapered lead in 60 about the centering stem 50 and a clearance recess well 70. A standardized socket wrench socket 80 for receiving standard socket wrench fittings such as 0.375 inches or 0.5 inches is located within the bottom surface 90 of the socket 10 as shown in FIG. 2.

Figure 7:
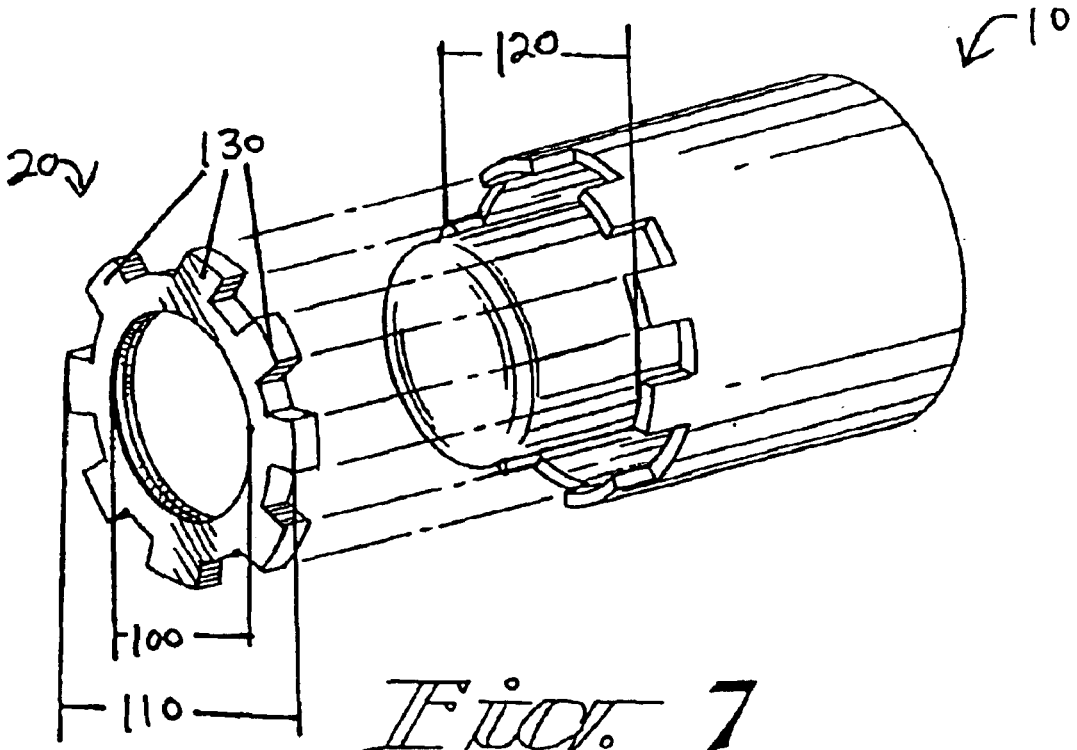
FIG. 7.

The socket skirt or wall 30 is generally sized and shaped to enclose a circular area substantially equal to the ring diameter 100 of a standardized electrical conduit lock nut 20 as shown in FIG. 7. The socket 10 shown in FIGS. 1–5 is designed to receive and manipulate a lock nut 20 having a ring diameter 100 of approximately 1 inch and a peripheral lug diameter 110 of about 1.325 inches. The outer diameter 120 of the skirt 30 shown is 1.410 inches so that it closely matches the peripheral diameter 110 of the lock nut when the teeth 40 are engaged with the lugs 130 of the lock nut 10. The outer diameter of the skirt 120 closely matching the peripheral diameter 110 of the lug profile is especially important in applications where the socket 10 is utilized in close proximity to other objects.

Figure 3:
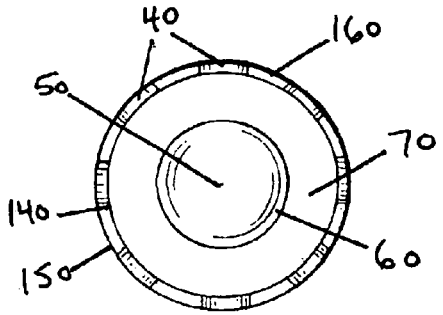
FIG. 3.
Figure 4:
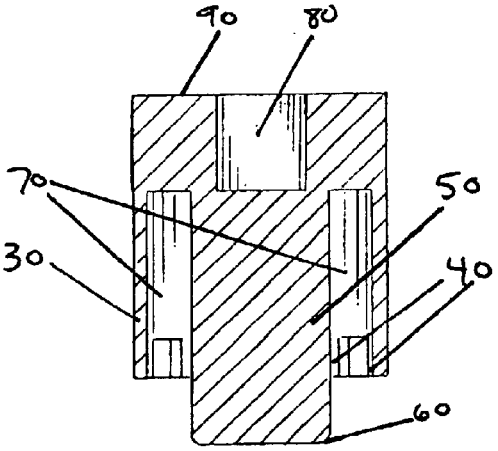
FIG. 4.
Figure 5:
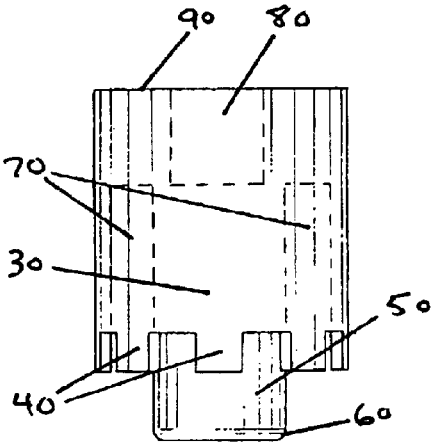
FIG. 5.
Figure 6:
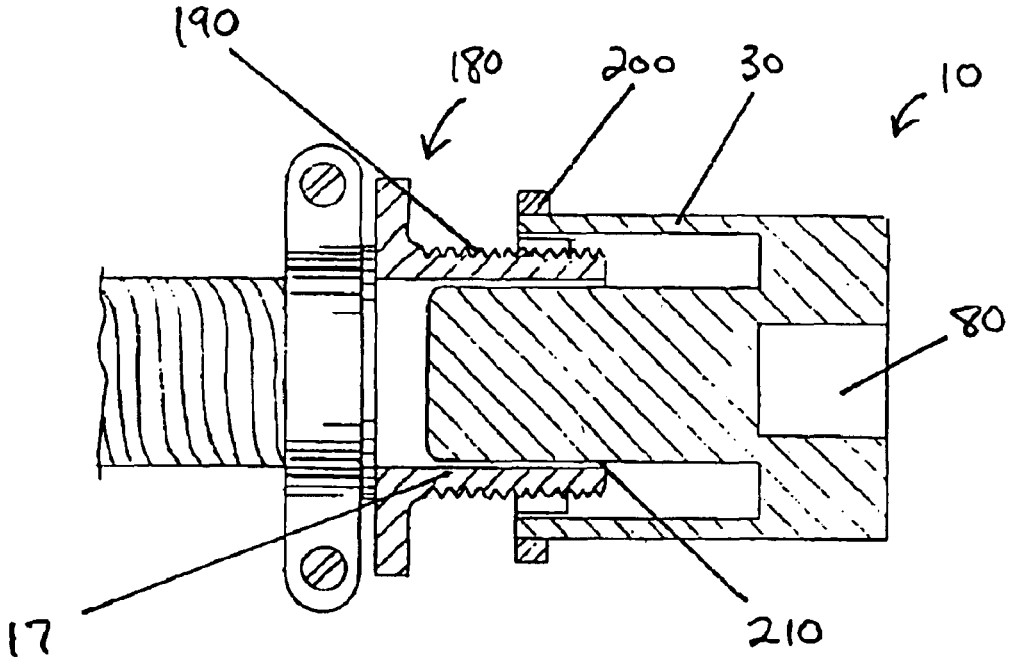
FIG. 6.

The wall or skirt 30 of the 1 inch socket 10 shown in FIG. 3 preferably has a uniform thickness of about 0.070 inches. The skirt 30 has a smooth inner face 140 and a smooth outer face 150 that terminates in a flat lip 160 between the teeth 40. The thickness of the lip 160 between the teeth 40 form faces for engaging the lugs 130 of the lock nut 20. The skirt wall 30 is about 1.060 inches in height forming a clearance recess 70 that allows clearance for the walls 170 of a conduit connector opening 180 during engagement of the socket 10 with a lock nut 20 that is fastened about the threads 190 of a conduit connector opening 180 as shown in FIG. 6.

The teeth 40 are spaced around the lip 160 of the skirt 30 at uniform intervals to matingly engage lugs 130 of the lock nut 20. The height of the teeth 40 are sized less than the standard thickness 200 of an electrical conduit lock nut 20. In a 1 inch lug nut socket 10 shown in FIG. 5, the height of each of the teeth is about 0.2 inches. The height of the teeth 40 are sufficient to firmly engage the lugs 130 when torsional forces are applied to the socket 10, yet short enough to not interfere with structure that may be disposed behind a lock nut 20 when the lock nut is tightened about the threads 190 of a conduit connector opening 180 such as that shown in FIG. 6. The teeth 40 are spaced at 0.276 inch intervals apart and are 0.276 inches in width. The 0.276 inch distance between the teeth 40 allow the socket 10 to engage a majority of 1 inch lock nuts 20 having lugs 130 of differing width. FIG. 3 shows the teeth 40 are arcuately shaped to match the curvature of the skirt 30 and to match the curvature of the lock nut 20 as shown in FIG. 7.

A centering stem or guide 50 centered within the skirt 30 is used to axially align the teeth 40 of the socket 10 with the lugs 130 of the lock nut 20 when the socket 10 is initially placed adjacent the conduit connector opening 180. The guide 50 is sized and shaped to be slightly smaller than the inner diameter 210 of the conduit connector opening 180 so that the guide 50 will fit firmly within the inner diameter 210 of the conduit connector opening 180. In a 1 inch socket 10 shown in FIGS. 1 and 3–5, the diameter of the centering stem 50 is about 0.755 inches and the inner diameter 210 of the conduit connector opening 180 is about 0.815 inches. The height of the centering stem 50 is generally greater than the height of the skirt 30 to allow the centering stem 50 to axially align the teeth 40 with the lock nut 20 before the teeth 40 come into contact with the lugs 130 of the lock nut 20 and is shorter than the length of the conduit connector opening 180 so that the centering stem 50 will not interfere with structure beyond the conduit connector opening 180. The height of the centering stem 50 in a 1 inch socket 10 is about 1.405 inches from the bottom of the clearance recess 70 to the tip of the centering stem 50, approximately 0.325 inches taller than the skirt 30 and teeth 40 height.

A tapered lead in portion 60 about the centering stem 50 provides spatial relief for initial engagement of the centering stem 50 with the inner diameter 210 of the conduit connector opening 180 as shown in FIG. 1. The tapered lead in 60 makes it easier for a user of the socket 10 to place the socket 10 in position for the socket 10 to be properly axially aligned with the lugs 130 of the lock nut 20 when the socket 10 is first being oriented with the lock nut 20 about an electrical conduit opening 180.

A well or gap 70 between the centering stem 50 and the teeth 40 provide a clearance recess for the protruding walls 170 of the conduit connector opening 180 to reside in during engagement of the teeth 40 with lugs 130 of a lock nut 20 when the lock nut 20 is tightened about the threads 190 of the conduit connector opening 180 as shown in FIG. 6. The typical combined thickness of the conduit connector wall 170 and height of the threads 190 surrounding the conduit connector opening 180 is about 940 inches. In a 1 inch socket 10 as shown in FIG. 3, the width of the well 70 is about 0.23 inches. The well 70 is about 0.42 inches deep allowing for the height of the walls 170 of the conduit connector opening 180, typically about 390 inches, to fully extend within the well 70 of the socket 10.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A socket for use in manipulating an electrical conduit lock nut, the socket comprising:

a circular bottom wall having a recess for receiving standard socket wrench fittings on an outer face of the circular bottom;

a centering guide connected to an inner face of the circular bottom sized and shaped to removably fit within a standard protruding lip of an electrical conduit connector opening;

a skirt wall about the circular bottom having a height greater than a standard protruding lip of an electrical conduit connector opening;

a plurality of spaced teeth extending from the side wall sized and shaped to intermesh with lugs of an electrical conduit lock nut, the teeth sized less than a standard thickness of an electrical conduit lock nut;

a well between the centering guide and the skirt wall providing space for protruding walls of an electrical conduit opening.

2. The socket of claim 1 further comprising a tapered lead in portion about the centering guide providing spatial relief for initial engagement of the centering guide with an inner wall of a protruding electrical conduit opening.

3. The socket of claim 2 wherein the centering guide has a height greater than the height of the skirt wall and shorter than the inner wall of the protruding electrical conduit opening.

4. The socket of claim 3 wherein the teeth have height to engage at least half of a side portion of each of the lugs.

5. The socket of claim 4 wherein the teeth have height less than a standard thickness of an electrical conduit lock nut.

6. A socket for use in manipulating a multi-lugged lock nut, the socket comprising:

a circular bottom wall sized and shaped to substantially match the size and shape of a lock nut having a plurality of radially spaced lugs, the bottom having a recess for receiving standard socket wrench fittings on an outer face of the circular bottom;

a rigid skirt of uniform thickness encircling the circular bottom, the skirt having a substantially smooth inner face and a substantially smooth outer face, the inner face and outer face terminating in a substantially flat lip;

a plurality of uniformly spaced teeth extending from the skirt sized and shaped to engage a plurality of lugs of a lock nut;

a centering guide connected to an inner face of the circular bottom sized and shaped to fit within a central opening of a lock nut, the centering guide axially aligning the teeth with lugs of a lock not when the centering guide is positioned within the central opening of the lock nut;

a tapered lead in portion about the centering guide providing spatial relief for initial engagement of the centering guide with a central opening of a lock nut;

a clearance well between the centering guide and the skirt for receiving a ring portion of a lock nut.

7. The socket of claim 6 wherein the centering guide extends beyond the skirt.

8. The socket of claim 7 wherein the thickness of the skirt provides lands for engagement with lugs of a lock nut.

9. The socket of claim 8 wherein the outer surface of the skirt is substantially flush with a peripheral diameter of an electrical conduit lock nut lug profile when the teeth are engaged with the lugs of the lock nut.

10. A socket set for use in manipulating electrical conduit lock nuts of differing size, the set comprising:

a retaining structure providing means for retaining a plurality of sockets;

a plurality of sockets of differing size, each socket comprising:

a circular bottom wall having a recess for receiving standard socket wrench fittings, each recess of the plurality of sockets being of substantially the same size and shape;

a centering guide connected to an inner face of the circular bottom sized and shaped to removably fit within a standard protruding lip of an electrical conduit connector opening, each centering guide of the plurality of sockets having a different diameter to coact with electrical conduit connector openings of differing size;

a skirt wall about the circular bottom having height greater than a standard protruding lip of an electrical conduit opening, each skirt wall of the plurality of sockets having a different diameter to enclose a circular area substantially equal to an outer ring diameter of a standardized electrical conduit lock nut;

a plurality of teeth spaced at a predetermined distance apart extending from the skirt wall sized and shaped to engage lugs of an electrical conduit lock nut, the predetermined distance accommodating lugs of differing width, each of the plurality of teeth of the plurality of sockets having different predetermined spacing;

a well between the centering guide and the skirt wall providing space for protruding walls of an electrical conduit opening, each well of the plurality of sockets having a different size to receive an electrical conduit opening of different size.

11. The set of claim 10 wherein each tooth of the plurality of teeth of each of the plurality of sockets has an arcuate shape about the circular bottom.

12. The set of claim 11 further comprising a tapered lead in portion about each centering guide of each of the plurality of sockets providing spatial relief for initial engagement of the centering guide with an inner wall of a protruding electrical conduit opening.

13. The set of claim 12 wherein the centering guide of each of the plurality of sockets extends beyond the skirt wall of socket.

14. A socket for use in manipulating an electrical conduit lock nut, the socket comprising:

a rigid wall of uniform thickness sized and shaped to enclose a circular area substantially equal to an outer ring diameter of a standardized electrical conduit lock nut, the wall having a substantially smooth inner face and a substantially smooth outer face, the inner face and outer face terminating in a substantially flat lip, the outer face substantially flush with a peripheral diameter of an electrical conduit lock nut lug profile when the teeth are engaged with the lugs of the electrical conduit lock nut;

a plurality of uniformly radially spaced teeth adjacent the lip of the wall sized and shaped to matingly engage lugs of an electrical conduit lock nut, the teeth being arcuately shaped about the circular area and spaced about the flat lip of the rigid wall to sliplessly engage lugs of varying width when torsional force is applied to the rigid wall;

a centering stem centered within the rigid wall sized and shaped to coact with an inner wall of an electrical conduit opening to axially align the spaced teeth with lugs of an electrical conduit lock nut about the electrical conduit opening, the centering stem having a height greater than the rigid wall and shorter than protruding walls of the electrical conduit opening;

a tapered lead in portion about the centering stem providing spatial relief for initial engagement of the centering stem with an inner wall of an electrical conduit opening; and a gap between the centering stem and the teeth providing a clearance recess for protruding walls of an electrical conduit opening to reside during engagement of the teeth with lugs of an electrical conduit lock nut about the electrical conduit opening, the rigid wall having a height greater than a maximum height of the protruding walls of the electrical conduit opening.

15. The socket of claim 14 wherein the height of the teeth are sized less than a standard thickness of an electrical conduit lock nut.

16. The socket of claim 15 wherein the centering stem is connected to the rigid wall by a bottom wall perpendicularly disposed from the rigid wall, the bottom wall having a recess for receiving standard socket wrench fittings.

* * * * *